United States Patent [19]

Junghans

[11] Patent Number: 4,960,052

[45] Date of Patent: Oct. 2, 1990

[54] FILM INKING APPARATUS FOR A PRINTING PRESS

[75] Inventor: Rudi Junghans, Wilhelmsfeld, Fed. Rep. of Germany

[73] Assignee: Heidelberger Druckmaschinen Aktiengesellschaft, Heidelberg, Fed. Rep. of Germany

[21] Appl. No.: 308,434

[22] Filed: Feb. 8, 1989

[30] Foreign Application Priority Data

Feb. 11, 1988 [DE] Fed. Rep. of Germany ..... 3804204

[51] Int. Cl.[5] ..... B41F 31/06; B41F 31/04; B41L 27/12

[52] U.S. Cl. ..... 101/350; 101/365

[58] Field of Search ..... 101/350, 349, 363, 365, 101/364, 148, 207–210, 366; 118/259, 261, 262, 414

[56] References Cited

U.S. PATENT DOCUMENTS

| | | | |
|---|---|---|---|
| 2,986,088 | 5/1961 | Chase et al. | 101/350 |
| 4,040,348 | 8/1977 | Gertsch et al. | 101/350 |
| 4,148,256 | 4/1979 | Fischer | 101/350 |
| 4,428,291 | 12/1984 | Dorow | 101/350 |

FOREIGN PATENT DOCUMENTS

| | | | |
|---|---|---|---|
| 0036103 | 12/1984 | European Pat. Off. . | |
| 639293 | 12/1936 | Fed. Rep. of Germany . | |
| 2052806 | 5/1972 | Fed. Rep. of Germany . | |
| 2942734 | 11/1983 | Fed. Rep. of Germany . | |
| 3134796 | 12/1983 | Fed. Rep. of Germany . | |
| 3230119 | 2/1984 | Fed. Rep. of Germany | 101/350 |
| 3326916 | 2/1985 | Fed. Rep. of Germany | 101/350 |
| 3401886 | 8/1987 | Fed. Rep. of Germany . | |
| 1401718 | 12/1983 | France . | |
| 1159851 | 10/1966 | United Kingdom . | |
| 1409417 | 10/1975 | United Kingdom . | |

*Primary Examiner*—J. Reed Fisher

*Attorney, Agent, or Firm*—Nils H. Ljungman & Associates

[57] ABSTRACT

A film inking unit for a rotary printing machine includes a relatively slowly rotating ink fountain roller and a relatively faster film roller rotating the ink fountain and the film rollers being spaced from one another so as to form a gap therebetween, wherein before the inking unit rollers, as seen in direction of rotation of the film roller, there is provided at least one additional intermediate roller, which takes ink from the film roller, and a doctor blade for completely squeegeeing the ink from the additional roller and returning the ink to the ink reservoir prior to transference of the ink film onto relatively fast-running inking unit rollers.

20 Claims, 3 Drawing Sheets

FILM INKING APPARATUS FOR A PRINTING PRESS

BACKGROUND OF THE INVENTION

1. Field of the Invention:

The present invention relates to a film inking unit for a rotary printing press.

2. Description of the Prior Art:

A generic film inking unit is known from German Patent No. 29 42 734 which discloses a device for the return of ink and ink-water mixtures consisting of a cage-like container equipped with a plurality of roller elements which are in contact with each other, are mounted non-stationarily so as to be rotatable and which have circular cross-sections. On one side of the container, at least one of said roller elements can be driven by the ink fountain roller and on the other side of the container at least a second roller element can be driven by a subsequent fast-running roller. Such a device serves the purpose of continuously returning the ink-water mixture from the inking unit into the ink fountain. However, it cannot be excluded that, via the film roller, the roller elements carry ink from the ink fountain roller into the inking unit. Providing a plurality of roller elements which loosely rotate in the housing is rather elaborate and moreover causes additional noise. This device is neither designed nor suitable for minimizing the amount of ink forwarded from the ink fountain to the inking unit.

French Patent No. 1 401 718 specifies a short inking unit in which, via three intermediate rollers, an ink fountain roller transfers the ink directly onto an applicator roller for a plate cylinder. Thus, this inking unit relates to another species. FIG. 5 of this patent, however, shows an additional ink roller which is arranged beside the rollers transferring the printing ink and cooperates with a doctor blade. As specified on page 3, left column, fourth paragraph of this patent, the additional ink roller makes it possible to combine an ink knife and a doctor blade such that together they form an ink reservoir.

In order to reduce the thickness of an ink film in a film inking unit, German Patent No. 34 01 886 assigns to an ink roller of the ink roller train, a blade device which is engaged at the cylindrical surface of said ink roller, as seen in direction of rotation of said ink roller, after the ink transfer to the next ink roller. [See, for example, FIG. 9 of the patent.] In general, vibrator rollers have been used to minimize the ink transfer into the inking unit, as described in European Patent No. 0 036 103 and in other publications, the vibrator rollers being engageable only temporarily at the ink fountain roller and disengageable therefrom, respectively. At high machine speeds such ink vibrators are subjected to considerable strain. In particular, in the case of zones of very low ink consumption, the minimum ink transfer which can be attained is still too great, even when using such known vibrator rollers.

All of the above-mentioned patent and/or publications are hereby expressly incorporated by reference with the same effect as if their entire contents were set forth in full herein.

OBJECTS OF THE INVENTION

A principal object of the invention is the provision of a device capable of achieving a low but nonetheless sufficient ink transfer, with the purpose of further minimizing the adjustable minimum ink amount in a film inking unit.

SUMMARY OF THE INVENTION

Due to the provision of an additional roller and an associated doctor blade, the ink film taken up by the film roller is split before its first contact with the ink roller which introduces the ink into the inking unit. By continuously and completely removing the ink film delivered by this additional roller, the major portion of the ink taken up by the film roller is returned into the inking unit. This guarantees a constant exchange of the ink available in the inking unit. At the same time, an oversaturated emulsion is prevented from being generated in the inking unit. Even with the vibrator-type inking units, such an oversaturated emulsion may be formed when no ink is needed (e.g., on one side of the roller) and, as a result thereof, "dead ink" that means an over-saturated ink fountain and be split anew. There is hardly any difference between a vibrator-type inking unit and a film inking unit, as regards the amount of dampening medium which reaches the ink fountain together with the ink. The constant exchange of ink, however, ensures a better mixture so that the ink/water balance is more stable.

In the preferred embodiment, there is provided a pair of rollers consisting of an intermediate roller which contacts the film roller before the inking unit roller as seen in the direction of rotation of the film roller, the inking unit roller conveying the ink from a film roller into the inking unit. There is also provided a doctor roller, mounted coaxially to said intermediate roller, with a doctor blade returning the squeegeed ink directly into the ink fountain. Here, it is possible to arrange the doctor roller with the doctor blade directly above the ink fountain roller. Such an embodiment is particularly advantageous in combination with an ink fountain roller featuring a metering device which can be regulated zone by zone, as described, for example, in German Patent No. 34 01 886, with particular reference being had to FIG. 7 thereof. In this preferred embodiment, the presetting of the ink film is, in any case, more reliable compared with conventional film inking units because each zone is constantly provided with ink. By further opening the ink gap, zone by zone, it is possible for dirt particles to leave the ink fountain quite easily. The exact metering is facilitated considerably because of the larger adjusting steps.

Moreover, it should be emphasized that, in the present invention, due to the way the doctor blade is arranged, only the front side of the blade comes into contact with the ink. When washing the inking unit, the doctor blade can be pivoted into an approximately vertical position, such that the ink adhering to the doctor blade drips off and only a minor portion remains on the blade. It is not necessary to continue cleaning the blade because, after having been pivoted again into contact with the doctor roller, the blade edge is wiped off immediately, due to the spring-like engagement.

Another advantage, which is worth mentioning, of the present invention is to be seen in that the machine is no longer soiled by splashed ink-water drops.

One aspect of the invention resides broadly in an inking apparatus for a printing press, the printing press includes an ink reservoir, a plate cylinder and ink transfer apparatus, including at least one inking unit roller for transferring ink to the plate cylinder, the inking apparatus being operable to transfer ink from the ink reservoir to the ink transfer apparatus and comprising an ink fountain roller device for receiving ink from the ink reservoir and transporting the ink on its surface; a film roller device for receiving a quantity of ink from the ink fountain roller device, for transporting the received quantity of ink on its surface, and for transferring at least a portion of the quantity of ink received from the film roller device to the ink transfer apparatus; the film roller device being positioned adjacent the ink fountain roller device and spaced therefrom by a gap; doctor roller apparatus for receiving a quantity of ink from the film roller and for transporting the quantity of ink received from the film roller device on its surface: the doctor roller apparatus being outboard of the ink transfer apparatus; and apparatus for removing, from the surface of the doctor roller apparatus, at least a portion of the quantity of ink received from the film roller device and for returning the removed quantity of ink to the ink reservoir.

Another aspect of the invention resides broadly in an inking apparatus for a printing press, the printing press including an ink reservoir, a plate cylinder and ink transfer apparatus including at least one inking unit roller for transferring ink to the plate cylinder, the inking apparatus being operable to transfer ink from the ink reservoir to the ink transfer apparatus and including an ink fountain roller device for receiving ink from the ink reservoir and transporting the ink on its surface; a film roller device for receiving a quantity of ink from the ink fountain roller device, for transporting the received quantity of ink on its surface, and for transferring at least a portion of the quantity of ink received from the film roller device to the ink transfer apparatus; at least one intermediate roller device for receiving a quantity of ink from the film roller device and for transporting the quantity of ink received from the film roller device on its surface; doctor roller apparatus for receiving a quantity of ink from the at least one intermediate roller device and for transporting the quantity of ink received from the at least one intermediate roller device on its surface; the doctor roller apparatus being outboard of the ink transfer apparatus; and an apparatus for removing, from the surface of the doctor roller apparatus, at least a portion of the quantity of ink received from the film roller and for returning the removed quantity of ink to the ink reservoir.

Still another aspect of the invention resides broadly in an inking apparatus for a printing press, the printing press including an ink reservoir, a plate cylinder and ink transfer apparatus including at least one inking unit roller for transferring ink to the plate cylinder, the inking apparatus being operable to transfer ink from the ink reservoir to the ink transfer apparatus and including an ink fountain roller device for receiving ink from the ink reservoir and transporting the ink on its surface; a film roller device for receiving a quantity of ink from the ink fountain roller device, for transporting the received quantity of ink on its surface, and for transferring at least a portion of the quantity of ink received from the film roller device to the ink transfer apparatus; doctor roller apparatus for receiving a quantity of ink from the film roller and for transporting the quantity of ink received from the film roller device on its surface; the doctor roller apparatus being outboard of the ink transfer apparatus; and an apparatus for removing, from the surface of the doctor roller apparatus, up to substantially all of the quantity of ink received from the film roller and for returning the removed quantity of ink to the ink reservoir.

Yet another aspect of the invention resides broadly in a method for supplying ink in a printing press, the printing press including an ink reservoir, a plate cylinder and an inking roller unit including at least one inking unit roller for transferring ink to the plate cylinder, the method being operable to transfer ink from the ink reservoir to the inking roller unit and including the steps of providing an ink fountain roller having a surface; transferring ink from the ink reservoir to the surface of the ink fountain roller; providing a film roller having a surface; positioning the film roller adjacent the ink fountain roller and spaced therefrom by a gap; transferring a quantity of ink from the surface of the ink fountain roller to the surface of the film roller; transferring ink from the surface of the film roller to the inking roller unit; and following the transfer of the quantity of ink to the surface of the film roller, and prior to the transfer of ink from the film roller to the inking roller unit, returning a majority of the quantity of ink to the ink reservoir.

We now turn to a detailed description of the preferred embodiment of the invention, after first describing the drawings, wherein:

DESCRIPTION OF THE PREFERRED EMBODIMENT

Figure 1:
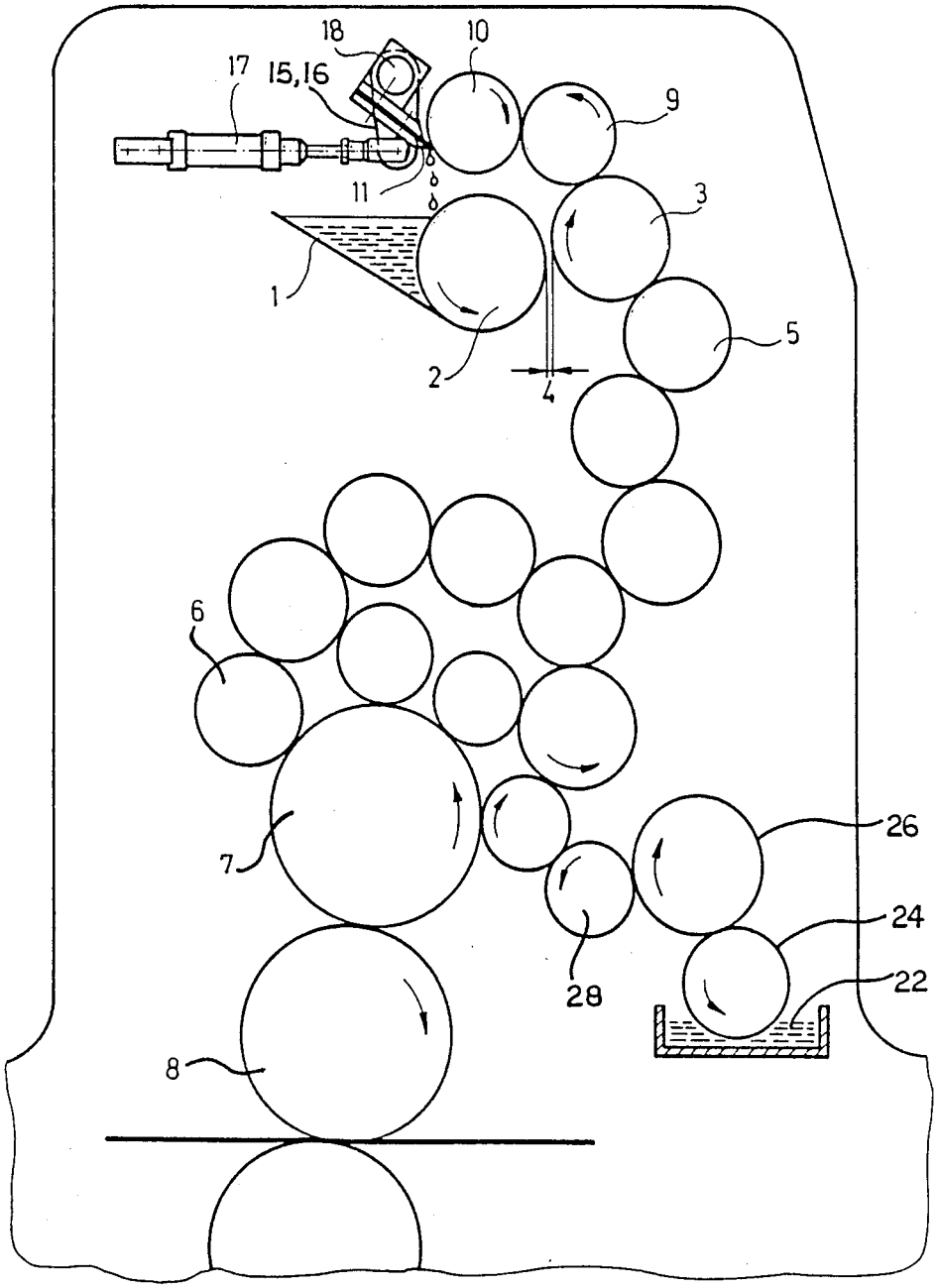
FIG. 1 is a schematic side view of a rotary printing press embodying the invention.

An ink fountain roller 2 disposed in an ink fountain 1 is equipped with a metering device which can be regulated zone by zone. Since such a device is well known, it is not shown in greater detail in the drawing. U.S. Pat. No. 4,660,470, issued Apr. 28, 1987 and entitled "Inking Unit Pre-Adjustment Method" describes such a well known zonal metering device which employs vibrator rollers for achieving zonally varying ink transfer from the ink fountain. This issued U.S. patent is hereby expressly incorporated by reference as if its entire contents were fully set forth herein. Such well known zonally varying ink profile is also illustrated in the publication entitled "Heidelberg CPC", published by Heidelberger Druckmaschinen AG, D-6900 Heidelberg (Publication No. HN 2/43.e), which publication is also hereby expressly incorporated by reference with the same effect as if its entire contents were fully set forth herein.

Figure 3:
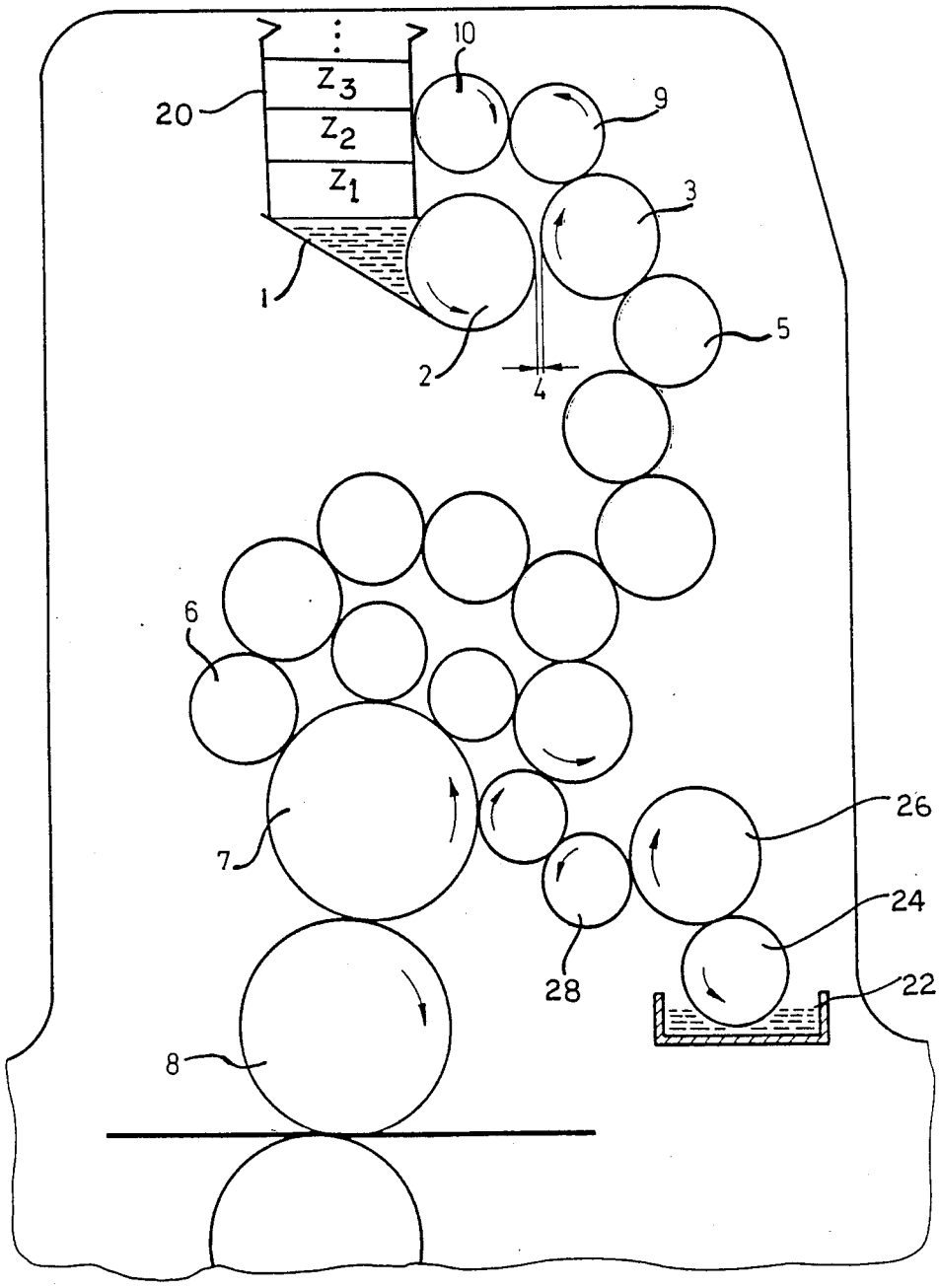
FIG. 3 is similar to FIG. 1, but shows schematically the means by which the ink supplied for printing is zonally varied in the transverse direction of the printing press.

Referring temporarily to FIG. 3, there is there shown, in simplified schematic form, the well known zonal ink metering apparatus which it is contemplated may be advantageously employed in conjunction with the present invention. In accordance with the principles and by means of apparatus well known in the prior art, the transversal direction of the printing press (corresponding to the longitudinal direction of, for example, ink fountain roller 2) is divided into zones $Z_1$, $Z_2$, $Z_3$, etc. The ink introduced into the printing press, via ink fountain roller 2, is zonally varied according to the zonal ink requirements of the particular printing operation being performed, resulting in a zonally varying ink profile.

Referring back to FIG. 1, ink fountain roller 2 rotates relatively slowly compared to a film roller 3 which rotates much faster (e.g., at the circumferential speed of the plate cylinder), the ink fountain roller 2 and the film roller 3 together forming a film gap 4 which has a predetermined width. Via an inking unit roller 5 and further additional inking unit rollers, part of the ink film taken up by the film roller 3 is conveyed into the inking unit and is finally transferred by an applicator roller 6 onto a plate cylinder 7, thereby inking a blanket cylinder 8. Before its first contact with the ink roller 5, which introduces the ink into the inking unit, the film roller 3 comes into contact with an additional intermediate roller 9 which cooperates with a doctor roller 10, preferably having a hard outer cylindrical surface, and with a doctor blade 11 [See FIG. 2.], mounted so as to be engageable with the doctor roller 10.

Also shown in FIG. 1 is a wetting agent reservoir 22, well known in the art and which, in cooperation with wetting agent transfer rollers 24, 26 and 28, serves to introduce a wetting agent into the inking roller unit.

Figure 2:
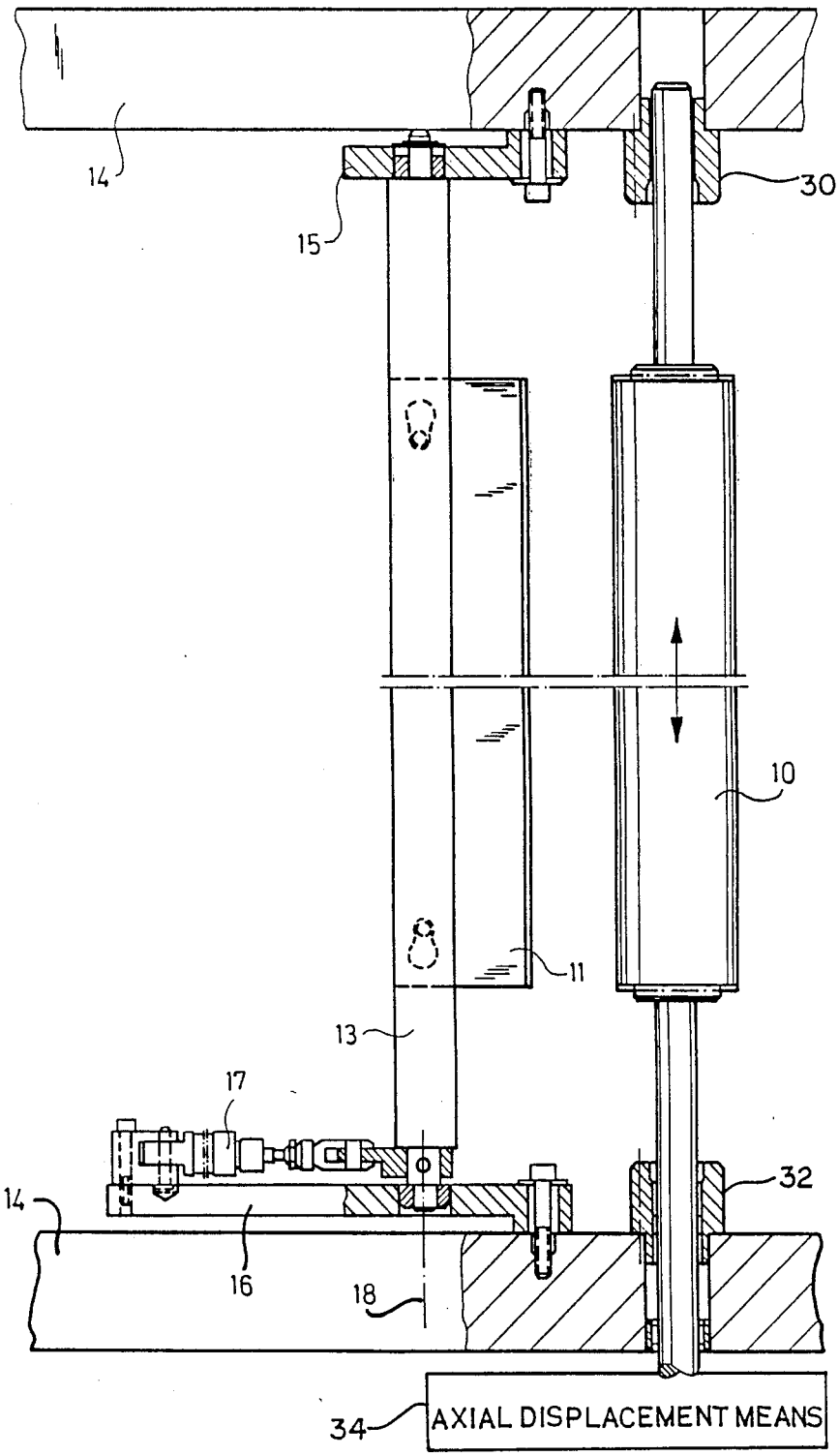
FIG. 2 is a schematic top view of a doctor roller and doctor blade used in the invention.

As shown in FIG. 2, the doctor blade 11 can be adjusted with respect to the doctor roller 10. In the preferred embodiment, the doctor blade 11 is fastened to a carrier 13, both ends of which are pivotally mounted in arms 15, 16, attached at the housing 14 so as to be adjustable and which can be pivoted about the pivot axis 18 by means of a hydraulic cylinder 17 for engaging and disengaging the doctor blade 11. Depending on the printing conditions, the doctor blade 11 can be engaged and disengaged via a respective drive control of an adjusting drive in arbitrary, determined or preprogrammed intervals, in order to be able to more flexibly regulated, for example, the range between minimum and maximum ink feed into the inking unit, or to achieve a washing effect, if so desired.

As seen in direction of rotation of the film roller 3, the ink film, taken up by the film roller 3, comes first of all into contact with the intermediate roller 9 before the ink film carried thereon comes into contact with the inking unit roller 5, which serves to introduce the ink into the inking unit. In this way, the major portion ($\frac{3}{4}$ of the ink) of the ink film taken up by the film roller 3 is delivered to the doctor roller 10 which is squeegeed continuously and completely by the doctor blade 11. As to the design, the arrangement is such that, the squeegeed ink is returned into the ink fountain as can be seen in the drawing. The squeegeed ink drops into the ink fountain according to the free fall, or is positively returned into the ink fountain, if so desired.

In an alternative embodiment of the invention, the entire device, consisting of the intermediate roller 9, the doctor roller 10 and the doctor blade 11 is arranged so as to be pivoted transversely, with respect to the axis of rotation of the film roller and so as to be engageable and disengageable, respectively, in order to attain the above-mentioned effect in a different manner. For example, the intermediate roller 11, the doctor roller 10 and the doctor blade 11 could be mounted as a group within a separate subframe which could then be displaceable (e.g., by a pivoting movement) between one engaged position wherein the intermediate roller 9 was in contact with the film roller 3 and another disengaged position wherein the intermediate roller 9 was not in contact with the film roller 3.

Additionally, it is contemplated as being within the scope of the invention to provide the doctor roller 10 with a heating device, so as to desirably alter the viscosity of the ink, and to mount the doctor roller 10 so as to be axially displaceable, in which case the doctor roller 10 may be moved axially when being washed. As can be seen in FIG. 2, doctor roller 10 is pivotally mounted in journal bearings 30 and 32, and is also slideable in its axial direction with respect to bearings 30 and 32. In order to mechanically effect an axial displacement of doctor roller 10 there is also preferably provided axial displacement means 34, which may be any of the mechanical displacement devices well known in the mechanical arts. An example, axial displacement means 34 could include a hydraulic cylinder (or ram), similar to hydraulic cylinder 17, discussed above, to effect axial displacement of doctor roller 10. Another example of a printing press structure in which a roller is capable of effecting axial movement is to be found in U.S. Pat. No. 3,118,373, issued Jan. 21, 1964 and entitled "Inker", which document is hereby expressly incorporated by reference, with the same effect as if it entire contents were set forth herein.

In summing up, an embodiment of the invention resides in a film inking unit for a rotary printing machine with a slowly rotating ink fountain roller and a film roller rotating fast compared to the ink fountain roller. The ink fountain roller and the film roller form a gap of pre-determined width, in which, before the inking unit rollers, as seen in the direction of rotation of the film roller, the film roller transfers the ink film onto fast-running inking unit rollers, cooperating with a device for returning ink and ink-water mixture. The device consists of at least one additional intermediate roller, which takes the ink from the film roller 3 but does not convey any ink into the inking unit, and of a doctor blade 11 for completely squeegeeing the ink film delivered by the roller.

Another aspect of the invention resides in that a pair of rollers consists of an intermediate roller 9. The intermediate roller contacts the film roller 3, as seen in the direction of rotation of the film roller, before the inking unit roller 5 conveys the ink from the film roller into the inking unit. A doctor roller 10 is mounted co-axially to the intermediate roller, with a doctor blade 11 returning the squeegeed ink directly into the ink fountain 1.

A further aspect of the invention resides in that the doctor blade 11 is arranged such that it can be moved transversely with respect to the axis of rotation of the doctor roller 10, and such, that it can be pivoted back and forth with respect to the doctor roller by means of an adjusting device.

Yet another aspect of the invention resides in that the doctor roller 10, with the doctor blade 11, is arranged directly above the ink fountain roller 2.

Still another aspect of the invention resides in that the ink fountain roller 2 is equipped with a metering device, featuring in a known manner, zone which can be regulated independently of each other.

And still yet another aspect of the invention resides in that the doctor blade 10 is mounted so as to be axially movable.

The invention as described hereinabove in the context of a preferred embodiment is not to be taken as limited to all of the provided details thereof, since modifications and variations thereof may be made without departing from the spirit and scope of the invention.

What is claimed is:

1. An inking apparatus for a printing press, said printing press comprising an ink reservoir and a plate cylinder, said inking apparatus being operable to transfer ink from said ink reservoir to said plate cylinder, said inking apparatus comprising:

ink transfer means for transferring ink to said plate cylinder, said ink transfer means comprising at least four inking unit rollers;

ink fountain roller means for receiving ink from said ink reservoir and transporting said ink on its surface;

film roller means for receiving a quantity of ink from said ink fountain roller means, for transporting said received quantity of ink on its surface, and for transferring at least a portion of said quantity of ink received from said ink fountain roller means to said ink transfer means;

said film roller means being positioned adjacent said ink fountain roller means and spaced therefrom by a gap;

means for rotating said ink fountain roller means at a rotational speed;

means for rotating said film roller means at a substantially greater rotational speed than the rotational speed of said ink fountain roller means;

at least one intermediate roller means for receiving a quantity of ink from said film roller means and for transporting said quantity of ink received from said film roller means;

said at least one intermediate roller means being in substantially constant contact with said film roller means at a point of contact therebetween;

means for rotating said at least one intermediate roller means and said film roller means in the same tangential direction and at the same tangential speed at said point of contact between said at least one intermediate roller means and said film roller means;

doctor roller means for receiving a quantity of ink from said at least one intermediate roller means and for transporting said quantity of ink received from said at least one intermediate roller means on its surface;

both of said doctor roller means and said at least one intermediate roller means being outboard of said ink transfer means;

said doctor roller means being in substantially constant contact with said at least one intermediate roller means at a point of contact therebetween;

means for rotating said doctor roller means and said at least one intermediate roller means in the same tangential direction and at the same tangential speed at said point of contact between said doctor roller means and said at least one intermediate roller means; and removal means for removing, from said surface of said doctor roller means, at least a portion of said quantity of ink received from said at least one intermediate roller means and for returning said removed quantity of ink to said ink reservoir;

said removal means comprising a doctor blade, said doctor blade extending across substantially the entire width of said doctor roller means.

2. The inking apparatus according to claim 1, wherein said at least one intermediate roller means comprises an intermediate roller positioned such that, in operation, said surface of said film roller passes sequentially past said ink fountain roller means, said intermediate roller and said ink transfer means.

3. The inking apparatus according to claim 1, further comprising means for displacing said doctor blade transversely with respect to the axis of rotation of said doctor roller means.

4. The inking apparatus according to claim 2, further comprising means for displacing said doctor blade transversely with respect to the axis of rotation of said doctor roller means.

5. The inking apparatus according to claim 4, wherein said doctor blade is pivotally mounted.

6. The inking apparatus according to claim 1, wherein said means for removing is positioned substantially over said ink reservoir.

7. The inking apparatus according to claim 6, wherein said means for removing is positioned substantially over said ink reservoir.

8. The inking apparatus according to claim 4, wherein said means for displacing said doctor blade includes means for maintaining said doctor blade in a first position wherein said doctor blade substantially engages said surface of said doctor roller means and in a second substantially vertical position.

9. The inking apparatus according to claim 8, wherein said surface of said ink fountain roller means is divided into a plurality of ink zones and wherein said printing press further comprises a plurality of ink zone metering devices for transferring variably metered quantities of ink from said ink reservoir to said ink zones on said surface of said ink fountain roller means.

10. The inking apparatus according to claim 9, further comprising means for axially displacing said doctor roller means.

11. A method for supplying ink in a printing press, said printing press comprising an ink reservoir, a plate cylinder and an inking roller unit comprising at least four inking unit rollers for transferring ink to said plate cylinder, said method being operable to transfer ink from said ink reservoir to said inking roller unit and comprising the steps of:

providing an ink fountain roller having a surface;

transferring ink from said ink reservoir to said surface of said ink fountain roller;

providing a film roller having a surface;

positioning said film roller adjacent said ink fountain roller and spaced therefrom by a gap;

transferring a quantity of ink from said surface of said ink fountain roller to said surface of said film roller;

transferring ink from said surface of said film roller to said inking roller unit;

following said transfer of said quantity of ink to said surface of said film roller, and prior to said transfer of ink from said film roller to said inking roller unit, returning a majority of said quantity of ink to said ink reservoir;

said returning of said majority of said quantity of ink to said ink reservoir comprising the steps of:

rotating said ink fountain roller at a rotational speed;

rotating said film roller at a substantially greater rotational speed than the rotational speed of said ink fountain roller;

providing an intermediate roller have a surface, said intermediate roller being positioned outboard of said inking roller unit;

transferring a quantity of ink from said surface of said film roller to said surface of said intermediate roller;

maintaining said intermediate roller and said film roller in substantially constant contact at a point of contact therebetween;

rotating said intermediate roller and said film roller in the same tangential direction and at the same tangential speed at said point of contact between said intermediate roller and said film roller;

providing a doctor roller having a surface, said doctor roller being positioned outboard of said inking roller unit;

transferring a quantity of ink from said surface of said intermediate roller to said surface of said doctor roller;

maintaining said doctor roller and said intermediate roller in substantially constant contact at a point of contact therebetween;

rotating said doctor roller and said intermediate roller in the same tangential direction and at the same tangential speed at said point of contact between said doctor roller and said intermediate roller; and removing, from said surface of said doctor roller, at least a portion of said quantity of ink received from said intermediate roller and returning said removed quantity of ink to said ink reservoir.

12. An inking apparatus for a printing press, said printing press comprising an ink reservoir, and a plate cylinder, said inking apparatus being operable to transfer ink from said ink reservoir to said plate cylinder, said inking apparatus comprising:

ink transfer means for transferring ink to said plate cylinder, said ink transfer means comprising at least four inking unit rollers;

ink fountain roller means for receiving ink from said ink reservoir and transporting said ink on its surface;

film roller means for receiving a quantity of ink from said ink fountain roller means, for transporting said received quantity of ink on its surface, and for transferring at least a portion of said quantity of ink received from said ink fountain roller means to said ink transfer means;

said film roller means being positioned adjacent said ink fountain roller means and spaced therefrom by a gap;

means for rotating said ink fountain roller means at a rotational speed;

means for rotating said film roller means at a substantially greater rotational speed than the rotational speed of said ink fountain roller means;

at least one intermediate roller means and for receiving a quantity of ink from said film roller means and for transporting said quantity of ink received from said film roller means;

said at least one intermediate roller means being in substantially constant contact with said film roller means at a point of contact therebetween;

means for rotating said at least one intermediate roller means and said film roller means in the same tangential direction and at the same tangential speed at said point of contact between said at least one intermediate roller means and said film roller means;

doctor roller means for receiving a quantity of ink from said at least one intermediate roller means and for transporting said quantity of ink received from said at least one intermediate roller means on its surface;

said doctor roller means being in substantially constant contact with said at least one intermediate roller means at a point of contact therebetween;

both of said doctor roller means and said at least one intermediate roller means being outboard of said ink transfer means;

means for rotating said doctor roller means and said at least one intermediate roller means in the same tangential direction and at the same tangential speed direction at said point of contact between said doctor roller means and said at least one intermediate roller means; and removal means for removing, from said surface of said doctor roller means, at least a portion of said quantity of ink received from said at least one intermediate roller means and for returning said removed quantity of ink to said ink reservoir.

13. The inking apparatus according to claim 12, wherein said removal means comprises a doctor blade positioned adjacent to said doctor roller means.

14. The inking apparatus according to claim 13, further comprising means for displacing said doctor blade transversely with respect to the axis of rotation of said doctor roller means.

15. The inking apparatus according to claim 14, wherein said doctor blade is pivotally mounted.

16. The inking apparatus according to claim 15, wherein said means for removing is positioned substantially over said ink reservoir.

17. The inking apparatus according to claim 16, wherein said means for displacing said doctor blade includes means for maintaining said doctor blade in a first position wherein said doctor blade substantially engages said surface of said doctor roller means and in a second substantially vertical position.

18. The inking apparatus according to claim 17, wherein said surface of said ink fountain roller means is divided into a plurality of ink zones and wherein said printing press further comprises a plurality of ink zone metering devices for transferring variably metered quantities of ink from ink reservoir to said ink zones on said surface of said ink fountain roller means.

19. The inking apparatus according to claim 18, further comprising means for axially displacing said doctor roller means.

20. The inking apparatus according to claim 19, wherein: said ink transfer means comprises fast running inking unit rollers;

said doctor roller means being disposed directly above the ink fountain roller means;

said removal means comprises means for the substantially complete removal from said surface of said doctor roller means of said quantity of ink received from said at least one intermediate roller means, wherein the rotational axis of said at least one intermediate roller means and the rotational axis of said doctor roller means are substantially parallel, wherein said inking apparatus additionally comprises means for pivotally displacing said doctor roller means toward and away from said at least one intermediate roller means, and means for the direct return of the ink removed from said surface of said doctor roller means to said ink reservoir; and adjustment means for adjusting said doctor blade towards and away from said doctor roller means.

* * * * *